US007025518B2

(12) United States Patent
Hoshino et al.

(10) Patent No.: US 7,025,518 B2
(45) Date of Patent: Apr. 11, 2006

(54) PRINTER FOR THERMALLY SENSITIVE ADHESIVE SHEET

(75) Inventors: Minoru Hoshino, Chiba (JP); Yoshinori Sato, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/766,586

(22) Filed: Jan. 28, 2004

(65) Prior Publication Data

US 2004/0218961 A1 Nov. 4, 2004

(30) Foreign Application Priority Data

Feb. 13, 2003 (JP) ..... 2003-034600

(51) Int. Cl.
*B41J 11/26* (2006.01)

(52) U.S. Cl. ..... 400/621; 400/582; 347/218

(58) Field of Classification Search ..... 400/582, 400/475, 61, 76; 347/218; 101/483, 484
See application file for complete search history.

(56) References Cited

U.S. PATENT DOCUMENTS 5,210,547 A * 5/1993 Watanabe et al. ..... 347/188
5,743,663 A * 4/1998 Imai ..... 400/120.04
6,447,186 B1 * 9/2002 Oguchi et al. ..... 400/621
2004/0017454 A1 * 1/2004 Yoshizawa et al. ..... 347/102
2004/0119809 A1 * 6/2004 Yoshida et al. ..... 347/220

FOREIGN PATENT DOCUMENTS

JP 11-079152 * 3/1999

* cited by examiner

*Primary Examiner*—Andrew H. Hirshfeld
*Assistant Examiner*—Marissa Ferguson
(74) *Attorney, Agent, or Firm*—Adams & Wilks

(57) ABSTRACT

A printer has a printing unit for printing during a printing operation on a printable surface of a thermally sensitive adhesive sheet having a thermally sensitive adhesive layer formed on a surface opposite to the printable surface. A first transporting mechanism transports the thermally sensitive adhesive sheet through the printing unit. A thermally activating unit heats the thermally sensitive adhesive layer of the thermally sensitive adhesive sheet and has a second transporting mechanism for transporting the thermally sensitive adhesive sheet through the thermally activating unit. A third transporting mechanism transports the thermally sensitive adhesive sheet from the printing unit to the thermally activating unit. A control device independently controls the first and second transporting mechanisms to thereby independently control a transporting speed of the thermally sensitive adhesive sheet during transportation thereof by the first and second transporting mechanisms.

16 Claims, 14 Drawing Sheets

PRINTER FOR THERMALLY SENSITIVE ADHESIVE SHEET

BACKGROUND OF THE INVENTION

1. Field of the Invention

The present invention relates to a printer having a thermally activating apparatus of a thermally sensitive adhesive or adhering sheet formed with a thermally sensitive adhering agent layer showing nonadhering performance in normal time and manifesting adhering performance by being heated on one face of a sheet-like base member and used as, for example, a pasting label, and particularly relates to a technology of enabling to transport a short label and promoting reliability of delivery of sheet from a printing apparatus to a thermally activating apparatus.

2. Description of the Related Art

In recent years, there is known a thermally activated sheet (for example, printing media formed with a coating layer including a thermally activating component on a surface thereof such as, for example, thermally sensitive adhering sheet) as one of sheets pasted on commodities, which is used in a wide field of pasting, for example, POS sheet of a good product, physical distribution/delivery sheet, medical sheet, baggage tag, display sheet of bottles, cans and the like.

The thermally sensitive adhering sheet is constituted by respectively forming a thermally sensitive adhering agent layer showing nonadhering performance in normal time and manifesting adhering performance by being heated on one face of a sheet-like base member and a printable face on other face thereof.

There has been proposed a printer for the thermally sensitive adhering sheet which is provided with a thermally activating apparatus for heating a thermally sensitive adhering agent layer by bringing a head having a plurality of resistors (heat generating elements) provided on a ceramic base plate as a heat source into contact with a thermally sensitive adhering label such as a thermal head utilized as a printing head of a thermal printer (Patent Literature 1).

An explanation will be given here of a general constitution of a printer for a thermally sensitive adhering sheet in reference to a thermal printer P2 of FIG. 14.

The thermal printer P2 of FIG. 14 is constituted by a roll containing unit 20 for holding a thermally sensitive adhering label 21 in a tape-like shape wound in a roll-like shape, a printing unit 30 for printing on the thermally sensitive adhering label 21, a cutter unit 40 for cutting the thermally sensitive adhering sheet 21 into a label having a predetermined length, and a thermally activating unit 50 as a thermally activating apparatus for thermally activating a thermally sensitive adhering agent layer of the thermally sensitive adhering label 21.

The printing unit 30 is constituted by a printing thermal head 32 having a plurality of heat generating elements 31 constituted by a plurality of comparatively small resistors arranged in a width direction thereof to be able to carry out dot printing, a printing platen roller 33 brought into press contact with the printing thermal head 32 (heat generating element 31) and the like. In FIG. 14, the printing platen roller 33 is rotated in the clockwise direction and the thermally sensitive adhering label 21 is transported to the right side.

The cutter unit 40 is for cutting the thermally sensitive adhering label 21 printed by the printing unit 30 by a preselected length and is constituted by a movable blade 41 operated by a drive source (not illustrated) of an electric motor or the like, and a fixed blade 42 opposed to the movable blade.

The thermally activating unit 50 is constituted by a thermally activating thermal head 52 as heating means having a heat generating element 51, a thermally activating platen roller 53 as transporting means for transporting the thermally sensitive adhering label 21, a drawing roller 54 for drawing the thermally sensitive adhering label 21 supplied from a side of the printing unit 30 to between the thermally activating thermal head 52 (heat generating element 51) and thermally activating platen roller 53 and the like. In FIG. 14, the thermally activating platen roller 53 is rotated in a direction opposed to that of the printing platen roller 33 (counterclockwise direction in the drawing) to transport the thermally sensitive adhering label 21 in a predetermined direction (right side).

[Patent Literature]

JP-A-11-79152

Meanwhile, according to the thermal printer P2 having the above-described constitution, the thermally sensitive adhering sheet is transported by three transporting means of the printing platen roller 33 of the printing unit 30, the drawing roller 54 and the thermally activating platen roller 53 of the thermally activating unit 50 and therefore, the printed sheet is cut after a front end thereof reaches the drawing roller 54. Therefore, a sheet length which can be dealt with becomes equal to or larger than a distance from a cutting position of the cutter unit 40 to the drawing roller 54. Therefore, in order to deal with a shorter sheet length, the thermally activating unit 50 needs to be proximate to the side of the cutter unit 40, however, there is a limit in shortening the distance between the thermally activating unit 50 and the cutter unit 40.

SUMMARY OF THE INVENTION

It is an object of the invention to provide a printer apparatus for a thermally sensitive adhering sheet capable of transporting a short label an capable of promoting reliability of delivery of a sheet form a printing unit to a thermally activating unit.

According to the invention, in order to achieve the above-described object, in a printer for a thermally sensitive adhering sheet, the printer comprising at least a printing apparatus including printing means for printing a printable layer of a thermally sensitive adhering sheet constituted by respectively forming a printable layer on one face of a sheet-like base member and a thermally sensitive adhering agent layer on other face thereof and first transporting means for transporting the thermally sensitive adhering sheet in a predetermined direction, a cutter apparatus provided at a poststage of the printing apparatus for cutting the thermally sensitive adhering sheet by a predetermined length, and a thermally activating apparatus including heating means arranged at a predetermined interval from a poststage of the cutter apparatus for heating the thermally sensitive adhering agent layer and second transporting means for transporting the thermally sensitive adhering sheet in the predetermined direction, further comprising third transporting means for transporting the thermally sensitive adhering sheet in the predetermined direction between the cutter apparatus and the thermally activating apparatus.

Thereby, distances among the respective transporting means are shortened and therefore, a short sheet length can easily be dealt with and reliability of delivery of a sheet from the printing apparatus to the thermally activating apparatus can be promoted.

Further, the third transporting means is constituted by one or two or more of discharge rollers-connected to a drive mechanism, the thermally sensitive adhering sheet is sandwiched between the discharge roller and a pressing member and the thermally sensitive adhering sheet is transported in the predetermined direction by driving to rotate the discharge roller. At this occasion, a plurality of the discharge rollers may be provided when there is an allowance in a space of installing the third transporting means.

Further, the discharge roller is constituted to be connected to the drive mechanism the same as a drive mechanism of the first transporting means and to be able to move cooperatively with the first transporting means. Thereby, the constitution of the apparatus can be simplified, transporting speeds of sheet by the first transporting means and the third transporting means can be made to be the same as each other and therefore, a failure in transportation such as paper jam can be prevented from being caused.

Further, by the construction of the above-described apparatus, after transporting a predetermined length of sheet from the printing apparatus, rotation of the first transporting means and the discharge roller is stopped and the sheet is transported only by the second transporting means. At that occasion, when the sheet is sandwiched between the discharge roller and the pressing means, the discharge roller is going to rotate in the predetermined direction.

Hence, it is preferable that the discharge roller is connected to the drive mechanism via a one way clutch to thereby limit transmission of power between the drive mechanism and the discharge roller in one direction.

Further, the discharge roller may be constructed so that it is partially brought into contact with the pressing member in a state in which the sheet is not inserted to thereby reduce friction force therebetween as less as possible. For example, when several pieces of O-rings are arranged at a peripheral face of the discharge roller, the O-rings and the pressing member are brought into point contact with each other to enable to restrain the friction force therebetween.

The discharge roller and the pressing member may be constituted to be able to be proximate to each other and remote from each other to thereby separate the discharge roller and the pressing member when the drive mechanism connected with the first and the third transporting means is stopped.

By this construction, even when the discharge roller is rotated after stopping the drive mechanism, the rotation is not transmitted to the drive mechanism or the first transporting means and therefore, an extra sheet can be prevented from being transported by rotation of the first transporting means and a load can be prevented from being applied on the drive mechanism.

Further, the pressing member may be constituted by an auxiliary roller brought into contact with the discharge roller. Thereby, a sheet can smoothly be transported since the auxiliary roller is also rotated in accordance with rotation of the discharge roller.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

A preferable embodiment of the invention will be explained in details in reference to the drawings as follows.

Figure 1:
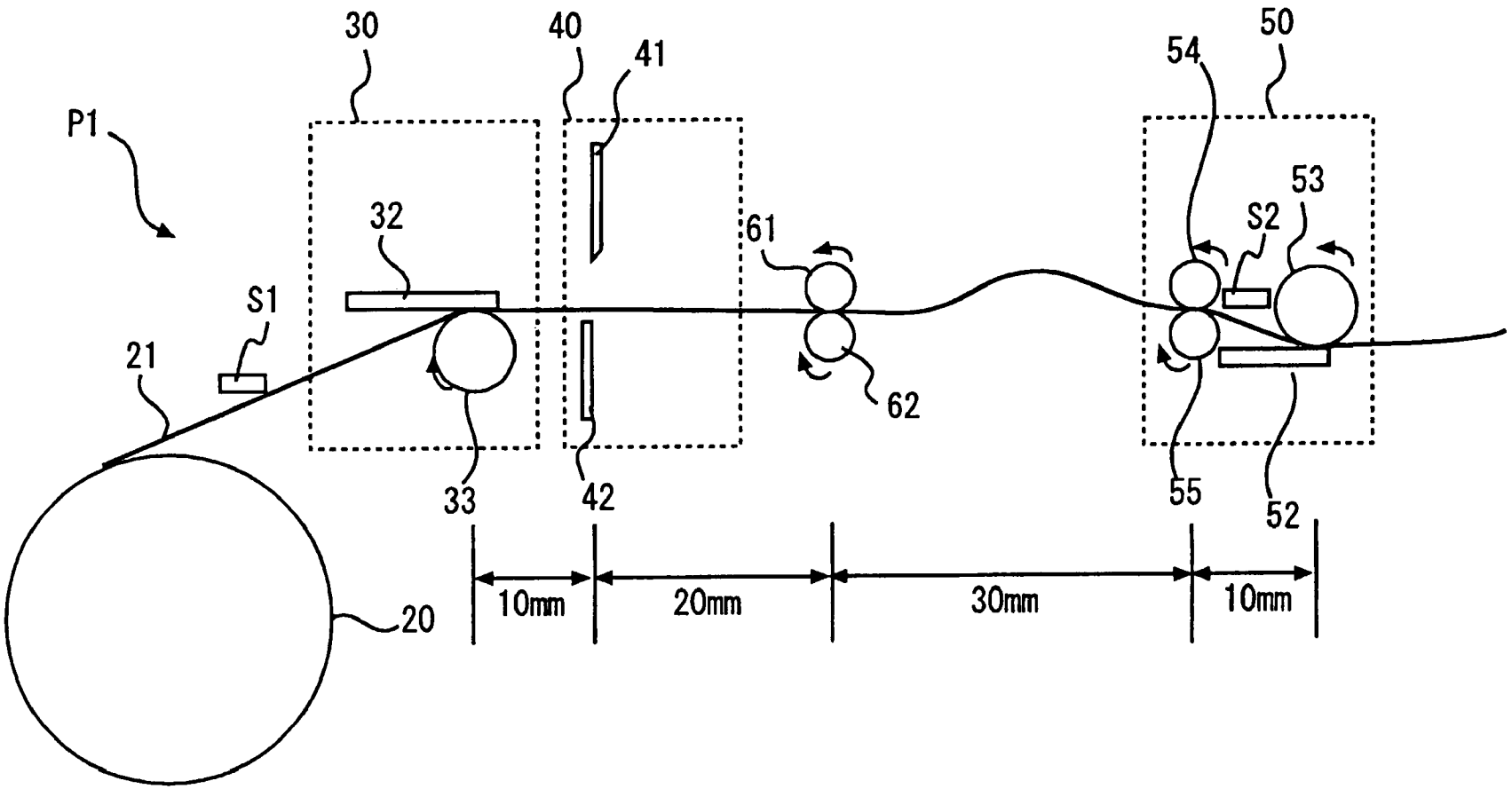
FIG. 1 is an outline view of a constitution example of a thermal printer P1 according to the invention.

FIG. 1 is an outline view showing a constitution of a thermal printer P1 for a thermally sensitive adhering sheet according to the invention. The thermal printer P1 is constituted by the roll containing unit. 20 for holding the thermally sensitive adhering label 21 in the tape-like shape wound in the roll-like shape, the printing unit 30 for printing the thermally sensitive adhering label 21, the cutter unit 40 for cutting the thermally sensitive adhering label 21 by a predetermined length, the thermally activating unit 50 for thermally activating the thermally sensitive adhering agent layer of the thermally sensitive adhering label 21, from the cutter unit 40 to the thermally activating unit 50 and the like.

In this case, although the thermally sensitive adhering label 21 used in the embodiment is not particularly restricted, the thermally sensitive adhering label 21 is constituted by a structure in which an insulating layer and a thermally sensitive coloring layer (printable layer) are formed on a surface side of a label-like base member as described in Patent Literature 1, mentioned above, and a rear face side thereof is formed with a thermally sensitive adhering agent layer constituted by coating and drying a thermally sensitive adhering agent. Further, the thermally sensitive adhering agent layer comprises a thermally sensitive adhering agent whose major component is thermoplastic resin, solid plastic resin or the like. Further, the thermally sensitive adhering label 21 may not be provided with the insulating layer or may be provided with a protecting layer or a colored printed layer (previously printed layer) at a surface of the thermally sensitive coloring layer.

The printing unit 30 is constituted by the printing thermal head 32 having a plurality of heat generating elements constituted by a plurality of comparatively small resistors arranged in the width direction to be able to carry out dot printing, and the printing platen roller 33 brought into press contact with the printing thermal head 32 and the like. The heat generating element is constructed by a constitution similar to that of a printing head of a publicly-known thermal printer constituted by providing a protecting film of glass-ceramics on surfaces of a plurality of heat generating resistors formed on a ceramic base plate by a thin film technology.

Further, the printing unit 30 is provided with a drive mechanism comprising a first stepping motor 110 (refer to FIG. 3) for rotating the printing platen roller 33 and a drive mechanism comprising a gear transmission mechanism and the like and the printing platen roller 33 is rotated in the clockwise direction by the drive mechanism to transport the thermally sensitive adhering label 21 to the right side. Further, the printing unit 30 is provided with pressing means, not illustrated, comprising, for example, a coil spring, a leaf spring or the like to press the printing platen roller 33 to the printing thermal head 32 by elastic spring force of the pressing means. In this case, press contact can uniformly be carried out over an entire width direction of the thermally sensitive adhering label 21 by maintaining a rotating shaft of the printing platen roller 33 and a direction of arranging the heat generating members in parallel with each other.

Further, a prestage of the printing thermal head 32 is provided with a paper sensor S1 and the printing platen roller 33 is controlled to drive based on detection of the thermally sensitive adhering label 21 by the paper sensor S1. For example, when the thermally sensitive adhering label 21 is detected by the paper sensor S1, a printing processing is made to be able to carry out and when the thermally sensitive adhering label 21 is not detected by the paper sensor S1, the processing of displaying an error message or the like is carried out.

The cutter unit 40 is for cutting the thermally sensitive adhering label 21 printed by the printing unit 30 by a predetermined length and comprises a movable blade 41 operated by a cutter drive portion 108 (refer to FIG. 3), the a fixed blade 42 made to be opposed to the movable blade 41.

The thermally activating unit 50 is constituted by the thermally activating thermal head 52 as heating means having at heat generating element, the thermally activating platen roller 53 as transporting means in the form of a transporting mechanism for transporting the thermally sensitive adhering label 21, a pair of drawing rollers 54 (drive) and 55 (driven) for drawing the thermally sensitive adhering label 21 transported from the side of the printing unit 30 to between the thermally activating thermal head 52 and the thermally activating platen roller 53 and the like.

Further, there is used the thermally activating thermal head 52 constructed by a constitution similar to that of the printing thermal head 32, that is, a constitution similar to a printing head of a public-known thermal printer constituted by providing a protective film of glass-ceramics on surfaces of a plurality of heat generating resistors formed on a ceramic base plate by a thin film technology according to the embodiment. A reduction in cost can be achieved by making parts common by using the constitution the same as that of the printing thermal head 32 as the thermally activating thermal head 52 in this way.

However, the heat generating element of the thermally activating thermal head 52 needs not to be divided by a unit of dot as in the heat generating elements of the printing thermal head 32 and may be constituted by a continuous resistor.

Further, the thermally activating unit 50 is provided with a drive mechanism comprising a second stepping motor 111 (refer to FIG. 3) for rotating the thermally activating platen roller 53 and the drawing roller 54, a drive mechanism comprising a gear transmission mechanism and the like and the thermally activating platen roller 53 and the drawing roller 54 are rotated in a direction opposed to that of the printing platen roller 33 (counterclockwise direction in FIG. 1) by the drive mechanism to transport the thermally sensitive adhering label 21 to the right side. Further, the thermally activating unit 50 is provided with pressing means (for example, coil spring or leaf spring) for pressing the thermally activating platen roller 53 to the thermally activating thermal head 52. In this case press contact can be carried out uniformly over an entire width direction of the thermally sensitive adhering label 21 by maintaining a rotating shaft of the thermally-activating platen roller 53 and a direction of arranging the heat generating member in parallel with each other.

Further, a paper sensor S2 is provided between the drawing rollers 54 and 55 and the thermally activating platen roller 53, and based on detection of the thermally sensitive adhering label 21 by the paper sensor S2, rotational driving of the drawing roller 54 and the thermally activating platen roller 53 and a processing of thermally activating the thermally activating thermal head 52 are controlled.

There can also be constructed a constitution provided with a guide unit for guiding the thermally sensitive adhering label 21 from the cutter unit 40 to the thermally activating unit 50.

Further, the thermal printer P1 of the embodiment includes discharge rollers 61 (drive) and 62 (driven) arranged at a poststage of the cutter unit 40 in a state of being brought into contact with each other and the discharge roller 61 is connected to the drive mechanism of the printing platen roller 33 via a gear transmission mechanism. In this case, according to the embodiment, the discharge roller 62 as an auxiliary roller is made to constitute pressing means for sandwiching the thermally sensitive adhering label 21 between the discharge roller 62 and the discharge roller 61. Further, it is also possible that a plate-like member (guide member or the like) is made to constitute pressing means in place of the discharge roller 62 and the thermally sensitive adhering label 21 is sandwiched by the plate-like member and the discharge roller 61 to transport.

Further, with regard to distances among the respective units of the thermal printer P1, for example, a distance from the printing platen roller 33 (printing thermal head 32) to the movable blade 41 is 10 mm, a distance from the movable blade 41 to a discharge roller 61 is 20 mm, a distance from the discharge roller 61 to the drawing roller 54 is 30 mm, and a distance from the drawing roller 54 to the thermally activating platen roller 53 (thermally activating thermal head 52) is 10 mm. In this way, the longest distance among the respective transporting means is 30 mm and therefore, a droop of a front end of the thermally sensitive adhering label 21 accompanied by transportation is made to be comparatively small and therefore, reliability of delivery of a label can be promoted.

Figure 2:
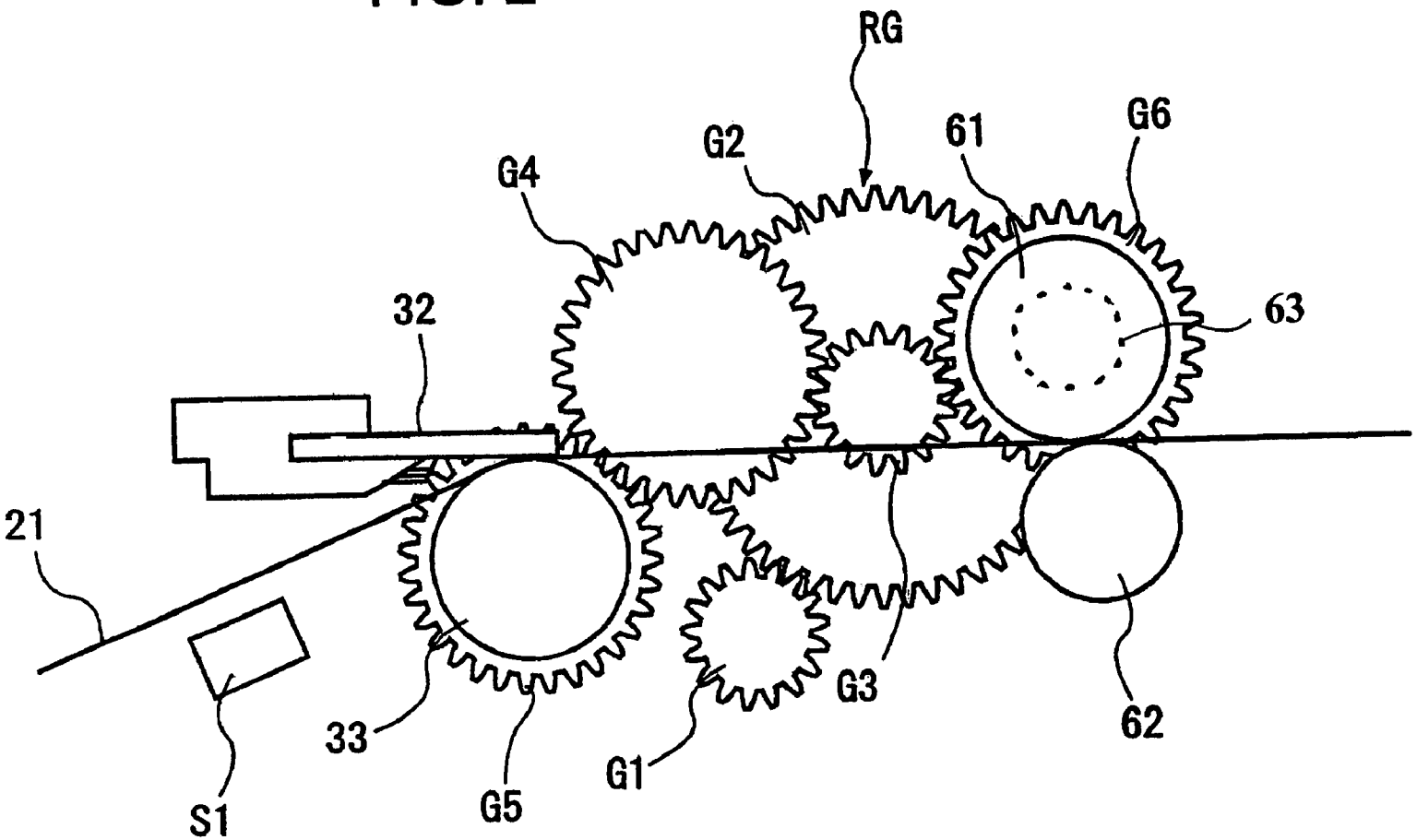
FIG. 2 is an explanatory view showing a gear transmission mechanism of a printing platen roller 33 and a discharge roller 61.

FIG. 2 is an explanatory view showing a gear transmission mechanism of the printing platen roller 33 and the discharge roller 61. The gear transmission mechanism shown in FIG. 2 is constituted by a gear G1 fixedly attached to the shaft of the first stepping motor 110, mentioned later, a reduction gear RG having two large and small gears G2 and G3, a gear G5 provided at a side portion of the printing platen roller 33 and a gear G6 provided at a side portion of the discharge roller 61. Further, a gear G4 is provided between the gear G5 and the reduction gear RG for reversing a rotational direction transmitted from the reduction gear RG. Further, by constituting the gears G5 and G6 by the same members and making a diameter of the printing platen roller 33 and a diameter of the discharger roller (drive) 61 the same as each other, rotational speeds of the printing platen roller 33 and the discharge roller 61 respectively connected thereto are made to be the same to thereby make transportation speed of the thermally sensitive adhering label 21 stays the same.

Further, by providing a one-way clutch 63 between the shaft of the discharge roller 61 and the gear G6, transmission of power between the discharge roller 61 and the first stepping motor 110 is limited to one direction.

According to the gear transmission mechanism, rotational force of the first stepping motor 110 is transmitted to the printing platen roller 33 via the reduction gear RG, the gear G4 and the gear G5 to thereby rotate the printing platen roller 33 in a predetermined direction. At the same time, the rotational force of the first stepping motor 110 is transmitted to the discharge roller 61 via the reduction gear RG and the gear G5 to thereby rotate the discharge roller 61 in the predetermined direction.

In this way, the thermally sensitive adhering label 21 is drawn from the containing unit 20 and the drawn thermally sensitive adhering label 21 is transported in the predetermined direction while being printed by the printing thermal head 32. That is, in FIG. 1 and FIG. 2, when the stepping motor 110 is rotated regularly (counterclockwise direction), the printing platen roller 33 is rotated in the clockwise direction and the discharge roller 61 is rotated in the counterclockwise direction to thereby transport the thermally sensitive adhering label 21 to the right side.

Conversely, when the first stepping motor 110 is rotated reversely (clockwise direction), the printing platen roller 33 is rotated in the counterclockwise direction and the thermally sensitive adhering label 21 is reeled back to the left side. At this occasion, since the discharge roller 61 is connected to the first stepping motor via the one-way clutch 63, the gear G6 is idly rotated and power is not transmitted to the discharge roller 61.

Further, when the first stepping motor 110 is not driven, there is a case in which the thermally sensitive adhering label 21 is transported by the drawing roller 54 and the thermally activating platen roller 53 and the discharge roller 61 is rotated thereby, however, power from the discharge roller 61 is not transmitted to the printing platen roller 33 and the first stepping motor 110 since the gear G6 is not rotated by the one way clutch. Thereby, a failure in transportation by rotating the printing platen roller 33 out of schedule can be prevented from being brought about and the first stepping motor 110 can be prevented from being applied with load.

Figure 3:
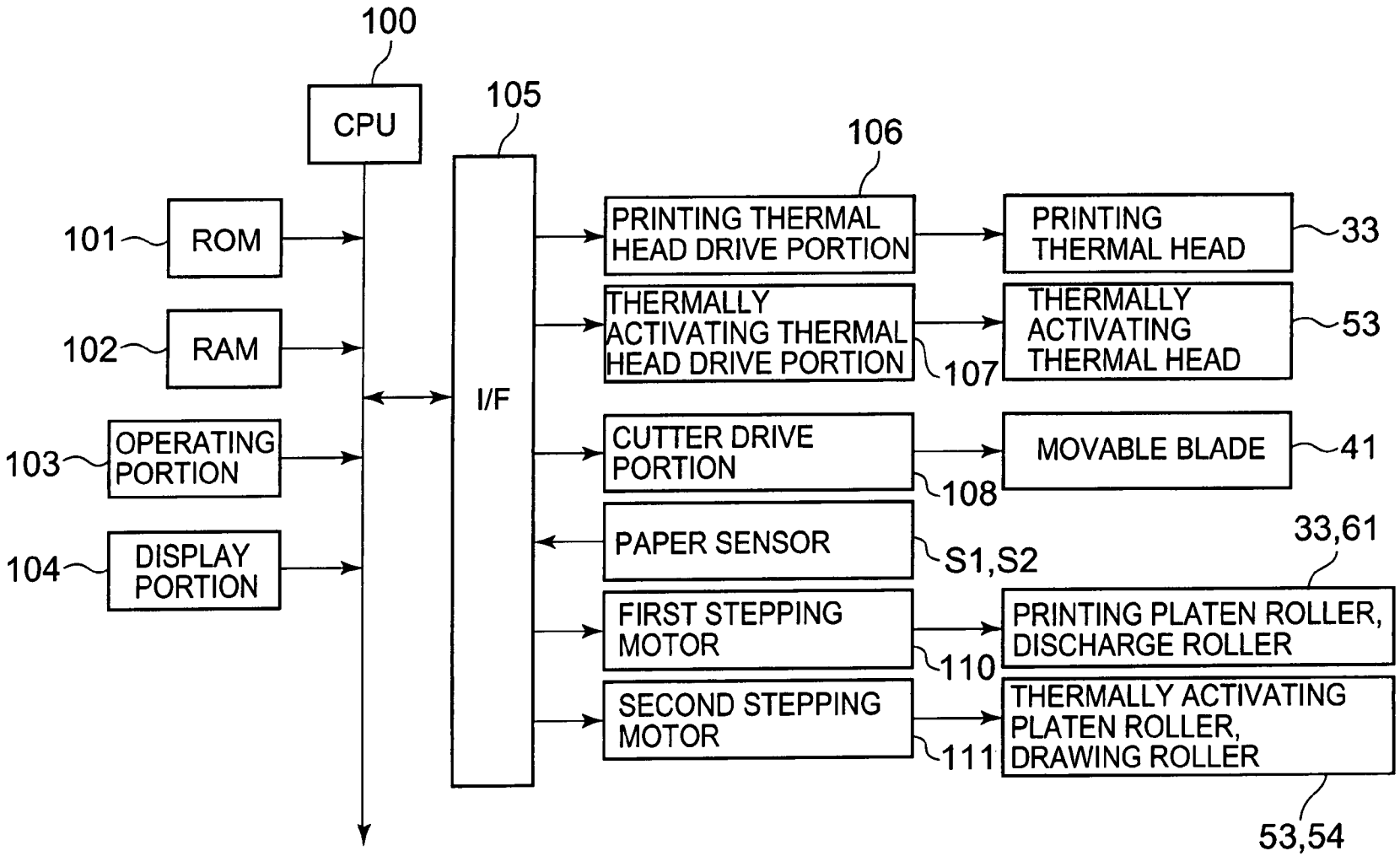
FIG. 3 is a block diagram showing a constitution example of a control system of the thermal printer P1.

FIG. 3 is a control block diagram of the thermal printer P1. A control portion of the thermal printer P1 is constituted by CPU 100 as a control apparatus for governing the control portion, ROM 101 for storing control programs or the like executed by CPU 100, RAM 102. for storing various print formats and the like, an operating portion 103 for inputting, setting or calling print data, print format data or the like, a display portion 104 for displaying print data or the like, an interface 105 for inputting and outputting data between the control portion and the drive portion, a drive circuit 106 for driving the printing thermal head 32, a drive circuit 107 for driving the thermally activating thermal head 52, the drive circuit 108 for driving the movable blade 41 for cutting the thermally sensitive adhering label 21, the paper sensors S1 and S2 for detecting the thermally sensitive adhering label, the first stepping motor 110 for driving the printing platen roller 33 and the discharge roller 61, the second stepping motor 111 for driving the thermally activating platen roller 53 and the drawing roller 54 and the like.

Base on control signals transmitted from CPU 100, desired printing operation is carried out at the printing unit 30, cutting operation is carried out at predetermined timing at the cutter unit 40 and activation of a thermally sensitive adhering agent layer 64 is carried out at the thermally activating unit 50.

Further, CPU 100 is constituted to be able to transmit control signals to the first stepping motor 110 and the second stepping motor 111 independently from each other. Thereby, rotational speeds of the printing platen roller 33 and the discharge roller 61 can be controlled by the first stepping motor 110, rotational speeds of the thermally activating platen roller 53 and the drawing roller 54 driven by the second stepping motor 111 can be controlled independently from each other, that is, speed of transporting the thermally sensitive adhering label 21 can independently be controlled.

Figure 4:
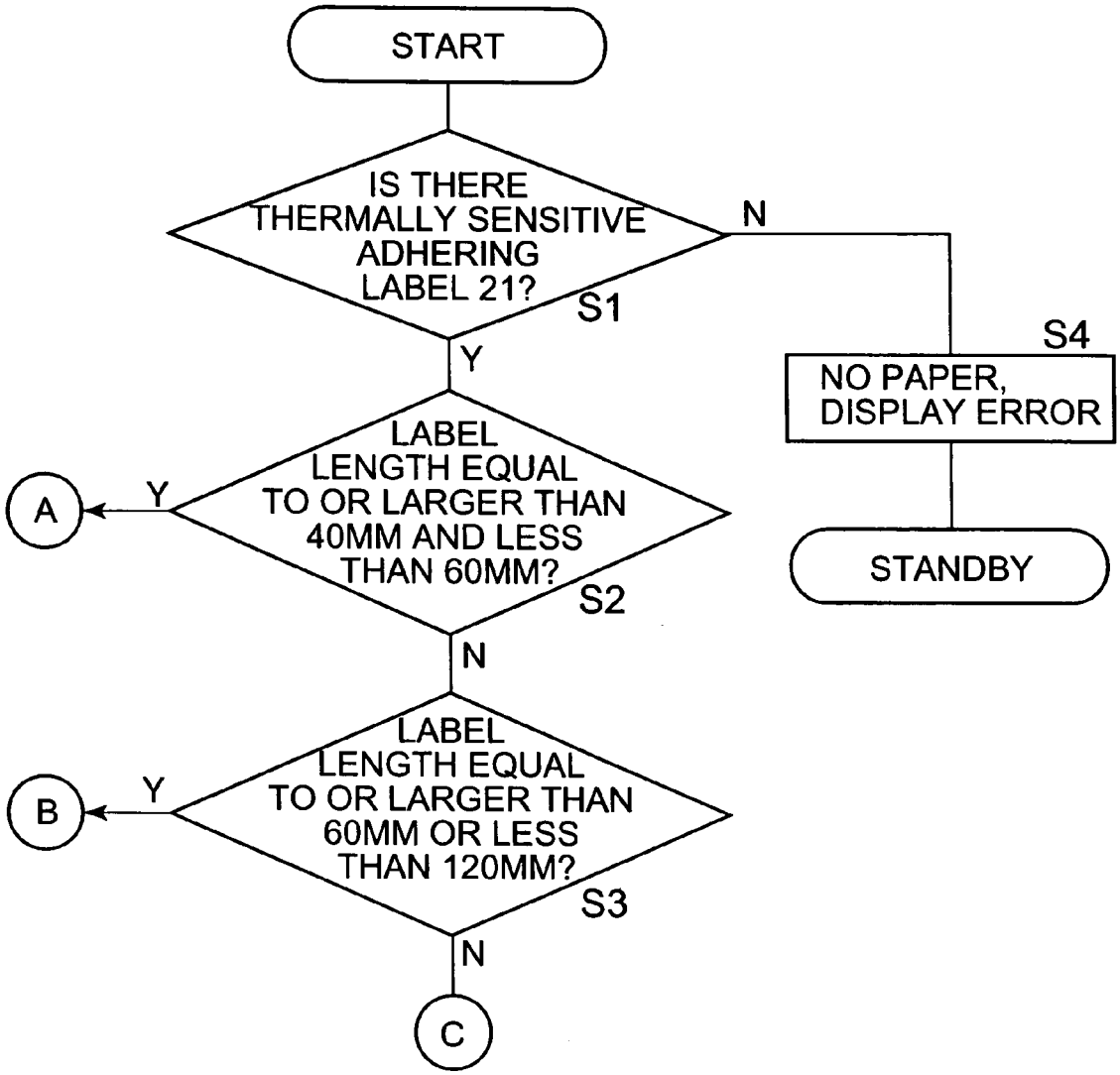
FIG. 4 is a flowchart of a printing processing and a thermally activating processing using the thermal printer P1.

Next, an explanation will be given of a printing processing and a thermally activating processing using the thermal printer P1 in reference to a flowchart of FIG. 4.

First, when printing is instructed to start by a user, it is determined whether the thermally sensitive adhering label 21 is set to the printing unit 30 based on a detection signal from the paper sensor S1 (step S1). Further, when it is determined that the thermally sensitive adhering label 21 is not set, the operation proceeds to step S4 to display an error message stating that the label is not set at the display portion 104.

Meanwhile, when it is determined that the thermally sensitive adhering label 21 is set at step S1, it is determined whether a length of the label to be printed based on a label length previously set by the user is equal to or larger than 40 mm and less than 60 mm (step S2). Further, when it is determined that the length of the label to be printed is equal to or larger than 40 mm and less than 60 mm, the operation proceeds to procedure A and proceeds to step S3 otherwise.

At step S3, it is determined whether the length of the label to be printed based on the label length previously set by the user is equal to or larger than 60 mm and less than 120 mm. Further, when it is determined that the length of the label to be printed is equal to or larger than 60 mm and less than 120 mm, the operation proceeds to procedure B and proceeds to procedure C otherwise.

Further, with regard to determination at the steps S2 and S3, other than determination based on the label length previously set by a user, the determination may be carried out based on print data or a transported length transported by the printing platen roller 33.

Figure 5:
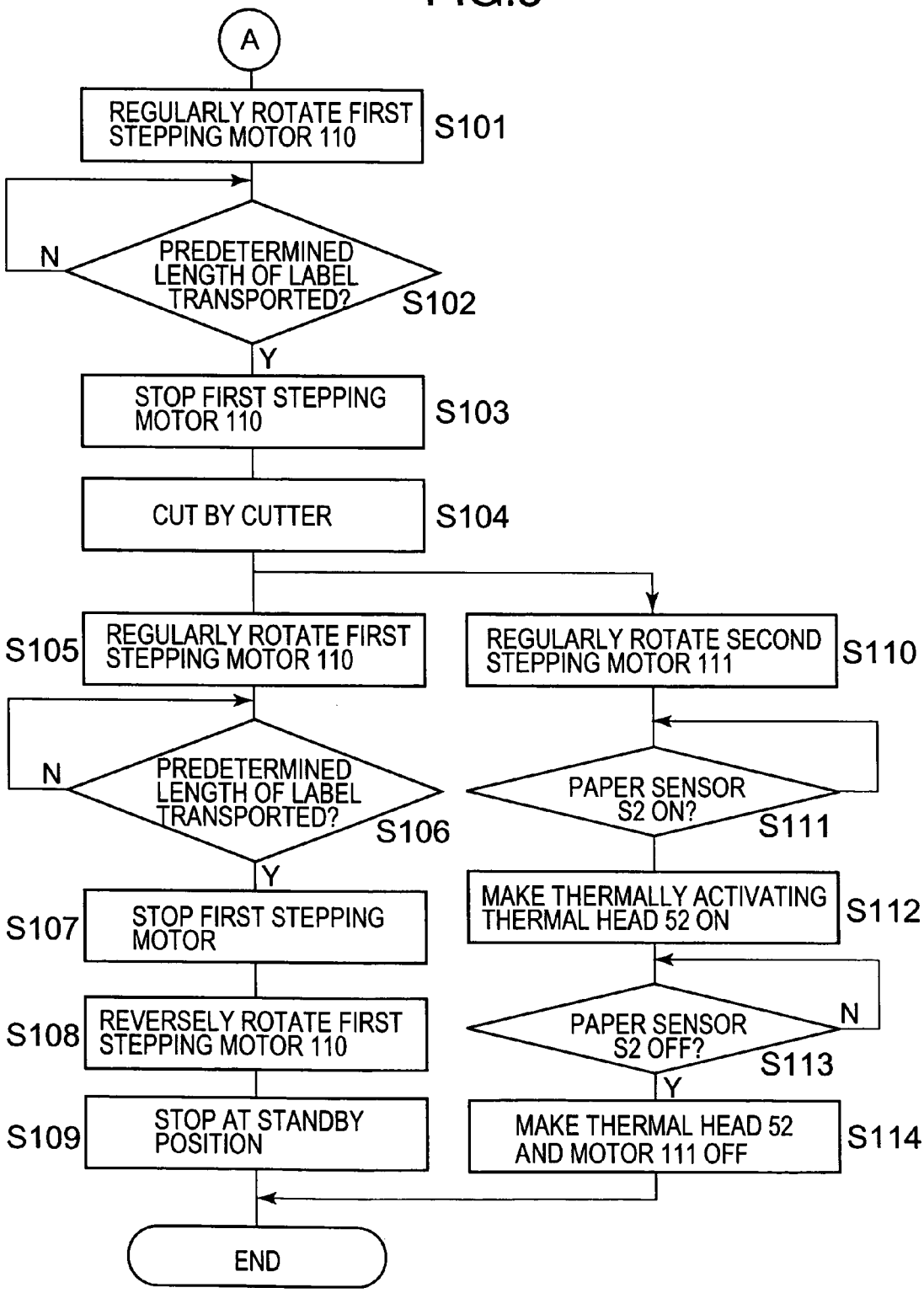
FIG. 5 is a flowchart of a printing processing and a thermally activating processing in accordance with a procedure A using the thermal printer P1.
Figure 6:
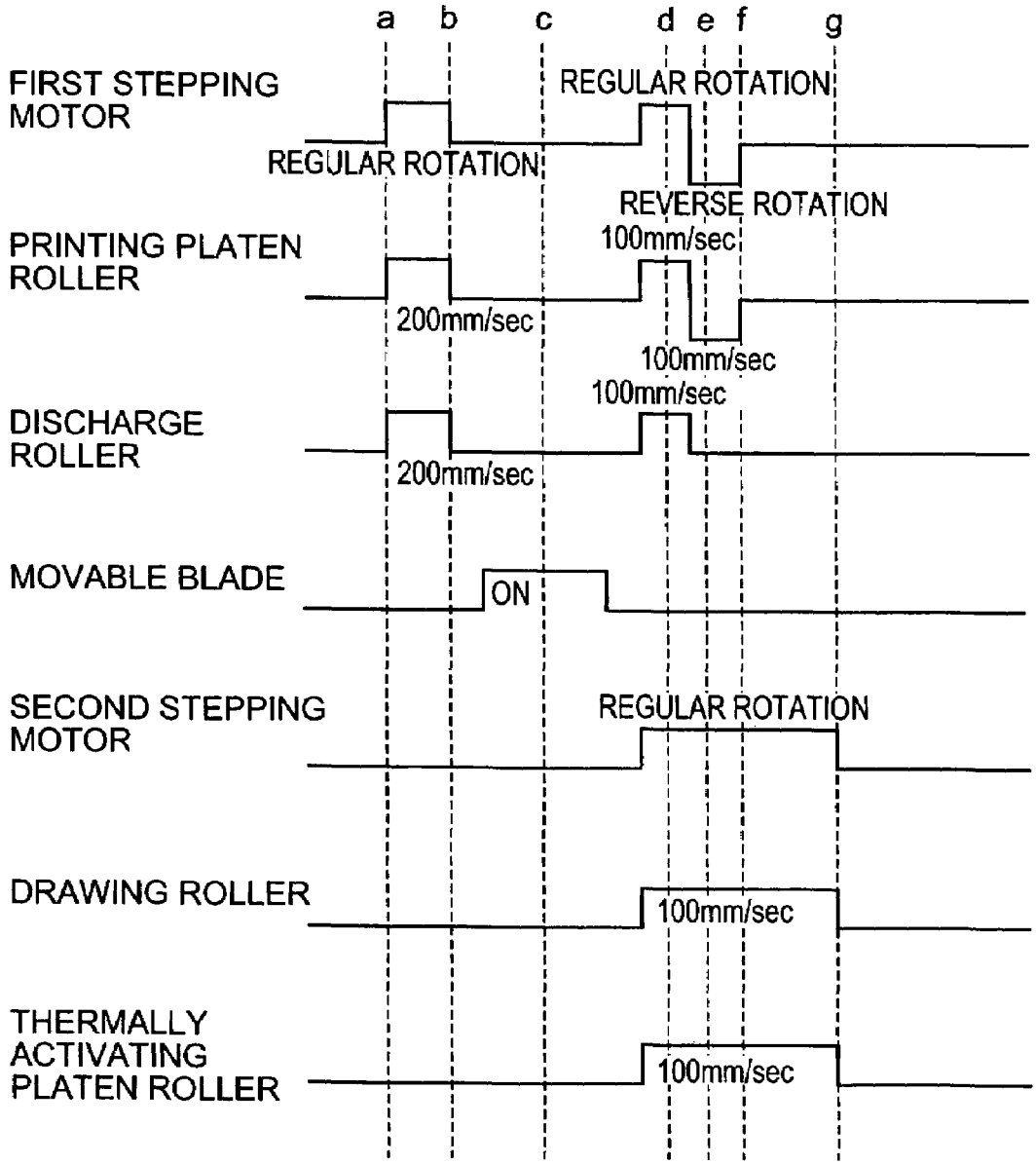
FIG. 6 is a timing chart showing states of driving respective driving means and respective transporting means of the thermal printer P1.
Figure 7A:
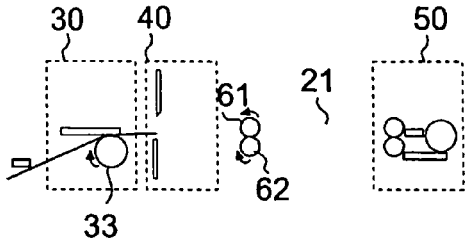
FIG. 7A–7G are an explanatory view showing states of transporting a thermally sensitive adhering label 21.
Figure 7B:
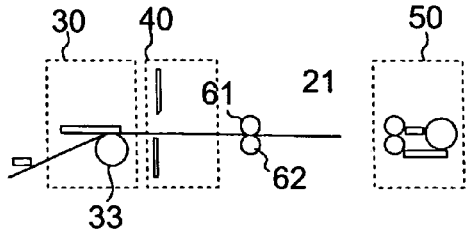
Figure 7C:
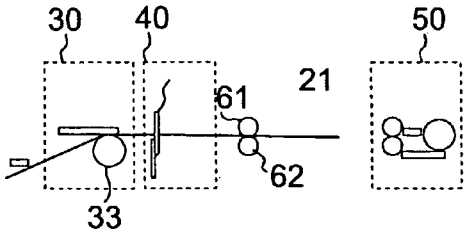
Figure 7D:
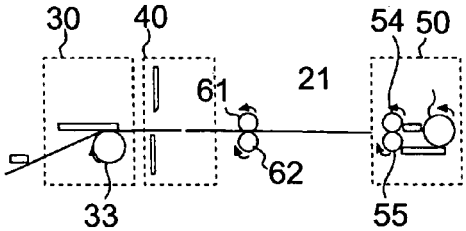
Figure 7E:
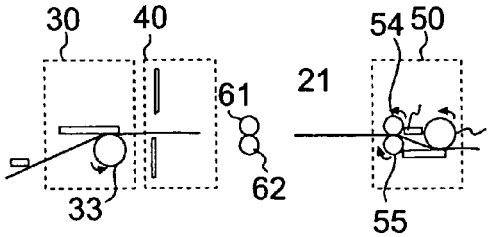
Figure 7F:
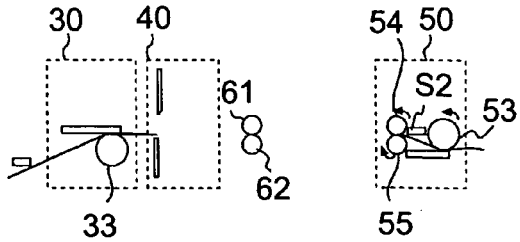
Figure 7G:
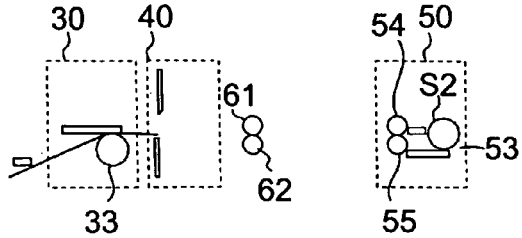

An explanation will be given of a printing processing and a thermally activating processing of procedure A in the case of the label length of 40 mm in reference to FIGS. 5 through 7 as follows. FIG. 5 is a flowchart of procedure A and FIG. 6 is a timing chart showing a state of driving the first stepping motor 110, the printing platen roller 33, the discharge roller 61, the movable blade 41, the second stepping motor 111, the drawing roller 54, and the thermally activating platen roller 53. Further, FIG. 7 is an explanatory view showing states of transporting the thermally sensitive adhering label 21 and respective states (a) through (g) correspond to notations a through g attached at an upper portion of the timing chart of FIG. 6.

Further, the transporting speed (printing speed) by the printing platen roller 33 and the discharge roller 61 is made to be variable to 200 mm/sec or 100 mm/sec and transporting speed (activating speed) by the thermally activating platen roller 53 and the drawing roller 54 is 100 mm/sec. Further, a time period for driving the movable blade 41 required for cutting the label at the cutter unit 40 is 0.4 sec.

First, at step S101, the first stepping motor 110 is regularly rotated, the printing platen roller 33 and the discharge roller 61 are started to drive to rotate, the thermally sensitive adhering label 21 is drawn at the transporting speed of 200 mm/sec and a printable layer (thermally sensitive coloring layer) is printed by the printing thermal head 52 (notation a of FIGS. 6, 7).

Next, when it is determined that the label having a predetermined length (40 mm) has been transported at step S102, the first stepping motor 110 is stopped to drive at step S103, (notation b of FIGS. 6, 7). At this occasion, the label length is counted based on a situation of driving the first stepping motor 110. Further, the label 21 is cut by the movable blade 41 at step S104 (notation c of FIGS. 6, 7).

After cutting the label 21, the first stepping motor 110 is rotated regularly to start to drive to rotate the printing platen roller 33 and the discharge roller 61. Further, the second stepping motor 111 is rotated regularly to start to drive to rotate the thermally activating platen roller 53 and the drawing roller 54 at step S110 to be prepared for delivery of the label 21 (notation d of FIGS. 6, 7).

Next, at the printing unit 30, when it is determined that a predetermined length of the label has been transported at step S106, the first stepping motor 110 is stopped at step S107 and successively, the first stepping motor is rotated reversely at step S108 (notation e of FIGS. 6, 7). At this occasion, the printing platen roller 33 is rotated reversely and the extra drawn label 21 is pulled back, however, the discharge roller 61 is not rotated since power is not transmitted thereto owing to the one way clutch. Further, the front end of the label 21 is returned to the cutting position of the cutter unit 40 at step S109 and the first stepping motor 110 is stopped (notation f of FIGS. 6, 7).

Meanwhile, at the thermally activating unit, when it is determined-that the front end of the label 21 has passed based on the detection signal from the paper sensor S2 at step S111, electricity conduction to the thermally activating thermal head is started at step S112. Further, the thermally activating processing is carried out until it is determined that a final end of the label 21 has passed based on the detection signal from the paper sensor S2 at step S113. Thereafter, after the final end of the label 21 has passed the paper sensor S2, after a predetermined time period, electricity conduction to the thermally activating thermal head 52 and driving of the second stepping motor 111 are stopped (notation g of FIGS. 6, 7).

According to the embodiment, a comparatively short label length of 40 through 60 mm can easily be dealt with by the processing in accordance with the above-described procedure A.

Figure 8:
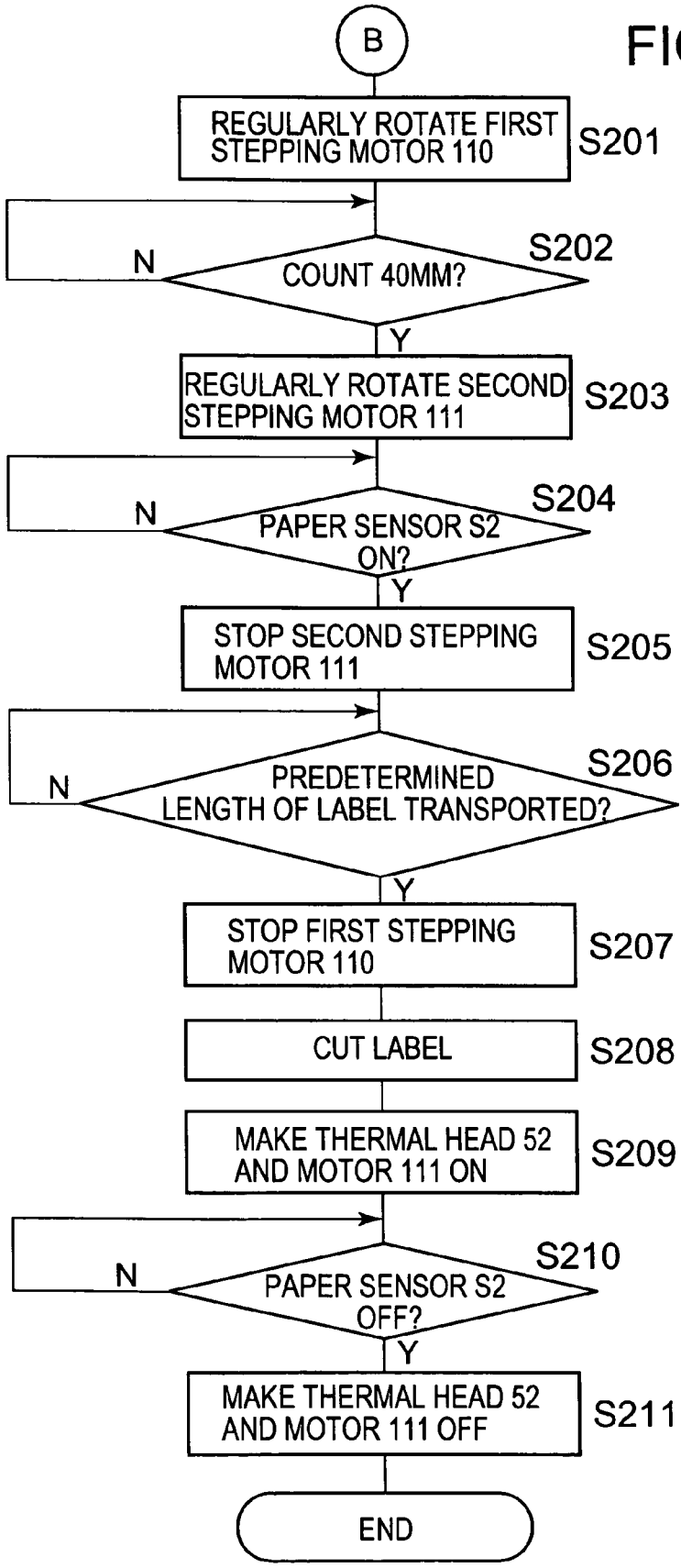
FIG. 8 is a flowchart of a printing processing-and a thermally activating processing in accordance with procedure B using the thermal printer P1.
Figure 9:
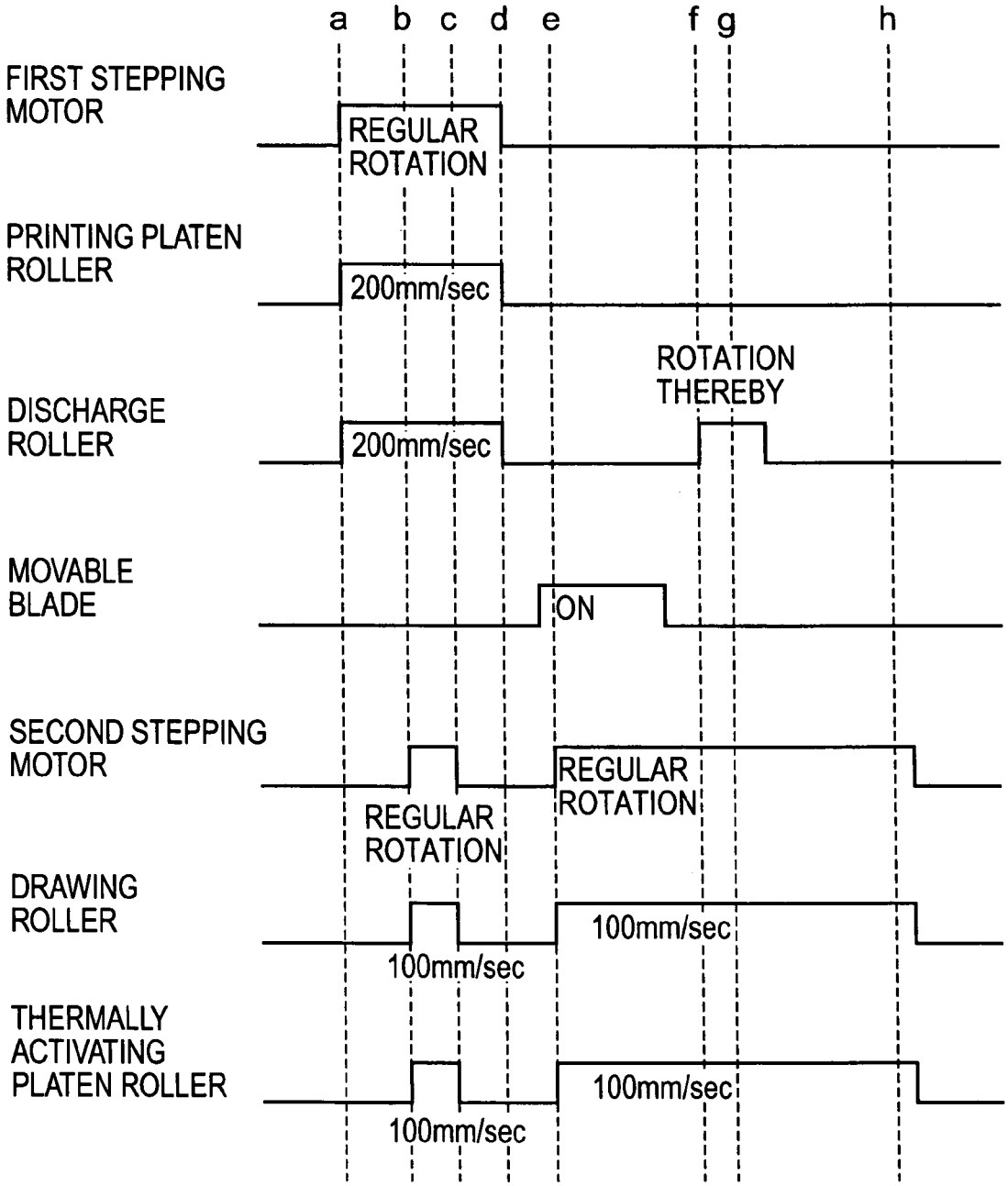
FIG. 9 is a timing chart showing states of driving the respective driving means and the respective transporting means of the thermal printer P1.
Figure 10A:
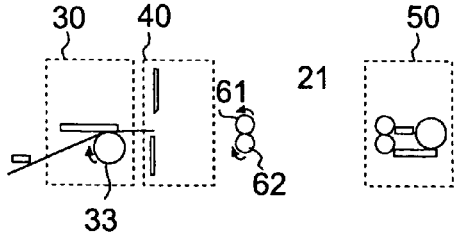
FIG. 10A–10H are an explanatory view showing states of transporting the thermally sensitive adhering label 21.
Figure 10B:
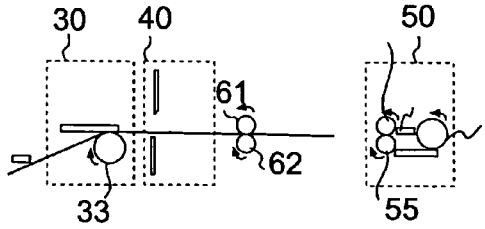
Figure 10C:
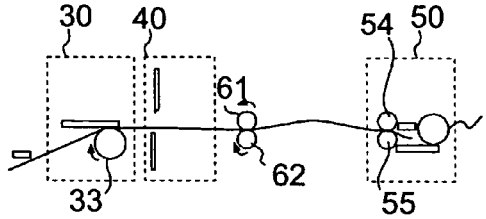
Figure 10D:
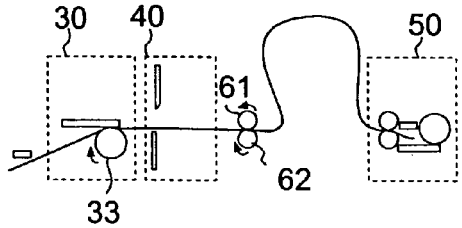
Figure 10E:
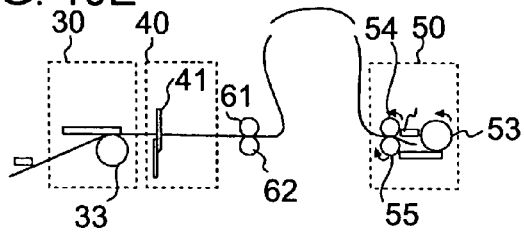
Figure 10F:
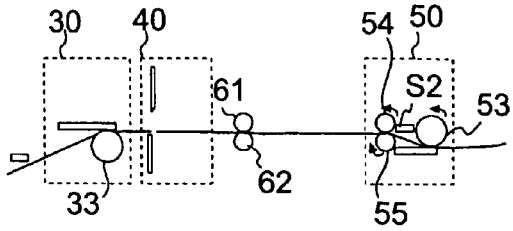
Figure 10G:
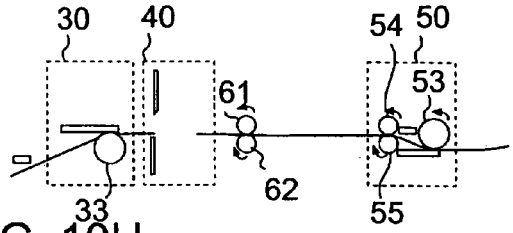
Figure 10H:
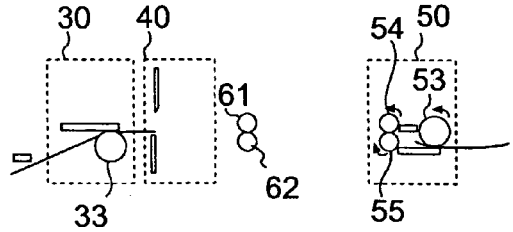

Next, an explanation will be given of a printing processing and a thermally activating processing of procedure B of FIG. 4 in the case of the label length of 100 mm in reference to FIGS. 8 through 10. FIG. 8 is a flowchart of procedure B and FIG. 9 is a timing chart showing states of driving the motors, the rollers and the like. Further, FIG. 10 is an explanatory view showing states of driving the thermally sensitive adhering label 21 and respective states (a) through (h) correspond to notations a through h attached to an upper portion of the timing chart of FIG. 9.

First, at step S201, the first stepping motor 110 is rotated regularly, the printing platen roller 33 and the discharge roller 61 are started to drive to rotate, the thermally sensitive adhering label 21 is drawn at transporting speed of 200 mm/sec and the printable layer (thermally sensitive coloring layer) is printed by the printing thermal head 52 (notation a of FIGS. 9, 10).

Next, when it is determined that the label of a predetermined length (40 mm) has been transported at step S202, *the second stepping motor 111 is rotated regularly at step S203 and the drawing roller 54 and the thermally activating platen roller 33 are started to drive to rotate to prepare for delivery of the label 21 (notation b of FIGS. 9, 10).

Successively, when the label 21 is detected based on the detection signal from the paper sensor S2 at step S204, the second stepping motor 111 is stopped to drive at step S205 (notation c of FIGS. 9, 10). At this occasion, the transporting speed by the printing platen roller 33 and the discharge roller 61 is 200 mm/sec, the transporting speed by the drawing roller 54 and the thermally activating platen roller 53 is 100mm/sec and therefore, the label 21 is slacked between the discharge roller 61 and the drawing roller 54 at the state of notation c of FIGS. 9 and 10. Further, after stopping the second stepping motor 111, the front end of the thermally sensitive adhering label 21 is not transported, however, the label 21 is transported from the printing unit 30 by the printing platen roller 33 and the discharge roller 61 and therefore, an amount of slacking the label 21 is further increased.

Next, when it is determined that a predetermined length (100 mm) of the label has been transported at step S206, the first stepping motor 110 is stopped to drive at step S207 (notation d of FIGS. 9, 10). Thereafter, the label 21 is started to be cut by the movable blade 41 at step S208, after starting cutting operation, electricity conduction to the thermally activating thermal head and driving of the second stepping motor 111 are started at step S209 to transport the thermally sensitive adhering label 21 at 100 mm/sec (notation e of FIGS. 9, 10). At this occasion, the label 21 is sufficiently slacked between the discharge roller 61 and the drawing roller 54 and therefore, the cutting processing can be carried out while transporting the label 21.

Further, when the slack amount is reduced in accordance with transportation of the label 21 and the slack of the label 21 has been removed finally, the label 21 is drawn from the discharge rollers 61 and 62 and the discharge rollers 61 and 62 are rotated thereby (notations f, g of FIGS. 9, 10).

Thereafter, the thermally sensitive adhering label 21 is transported by the thermally activating platen roller 53 and the drawing roller 54 and since the drawing roller 54 and the thermally activating platen roller 53 are provided with the same drive source and transporting speeds thereof are not shifted from each other, slack is not produced and extra tension is not operated between the drawing roller 54 and the thermally activating platen roller 53.

Next, the thermally activating processing is carried out until it is determined that the final end of the label 21 has passed based on the detection signal from the paper sensor S2. Further, after a predetermined time period after the final end of the label 21 has passed the paper sensor S2, electricity conduction to the thermally activating thermal head 52 and driving of the second stepping motor 111 are stopped at step S211 (notation h of FIGS. 9, 10).

In this way, according to the embodiment, the case of the label length of 60 through 120 mm is dealt with by the processing in accordance with the above-described procedure B. That is, in procedure B, the thermally activating processing at the thermally activating unit 50 is started after cutting the label 21 and therefore, it can be avoided to bring about a failure in transportation of bringing about paper jam by pasting the thermally sensitive adhering agent layer of the thermally sensitive adhering label 21 on the thermally activating thermal head 52 (heat generating element).

Figure 11:
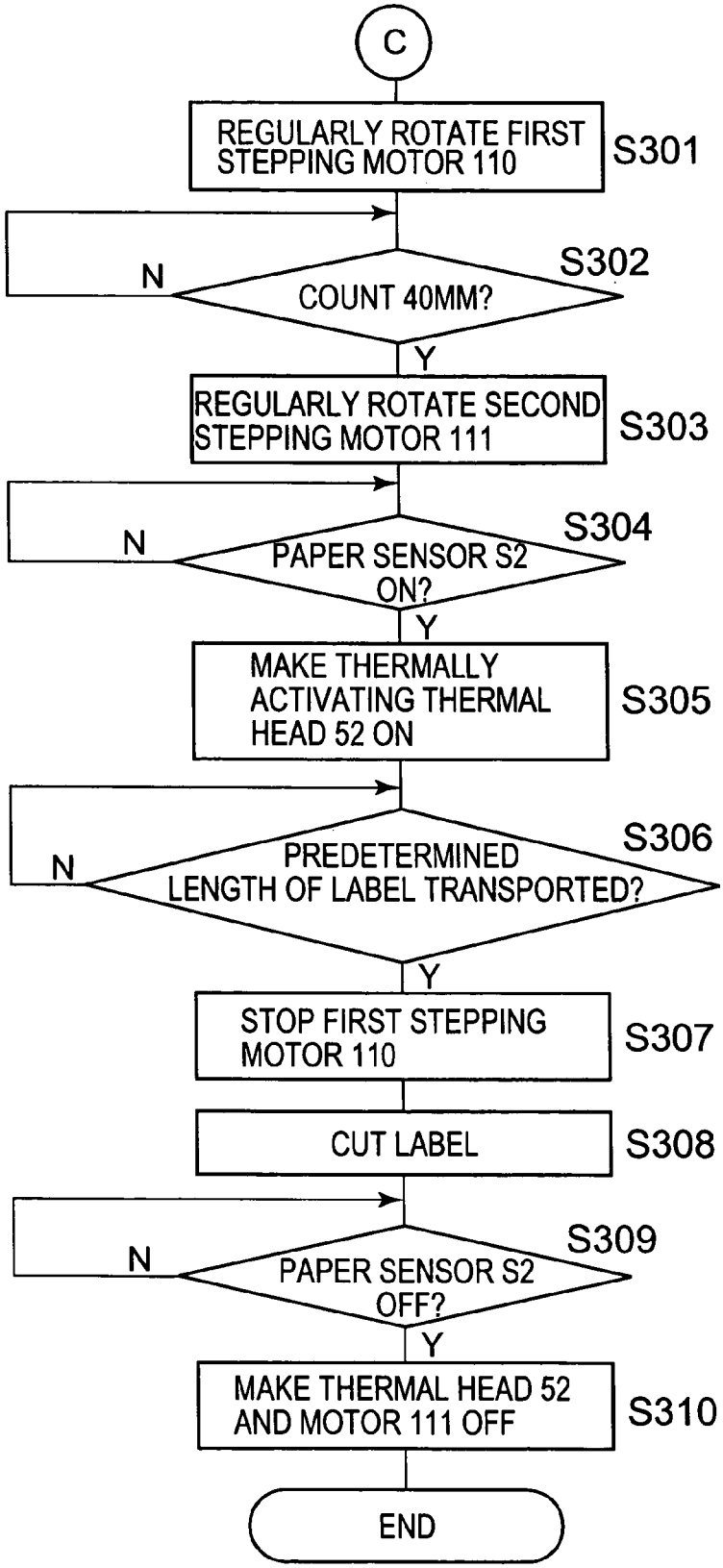
FIG. 11 is a flowchart of a printing processing and a thermally activating processing in accordance with procedure C using the thermal printer P1.
Figure 12:
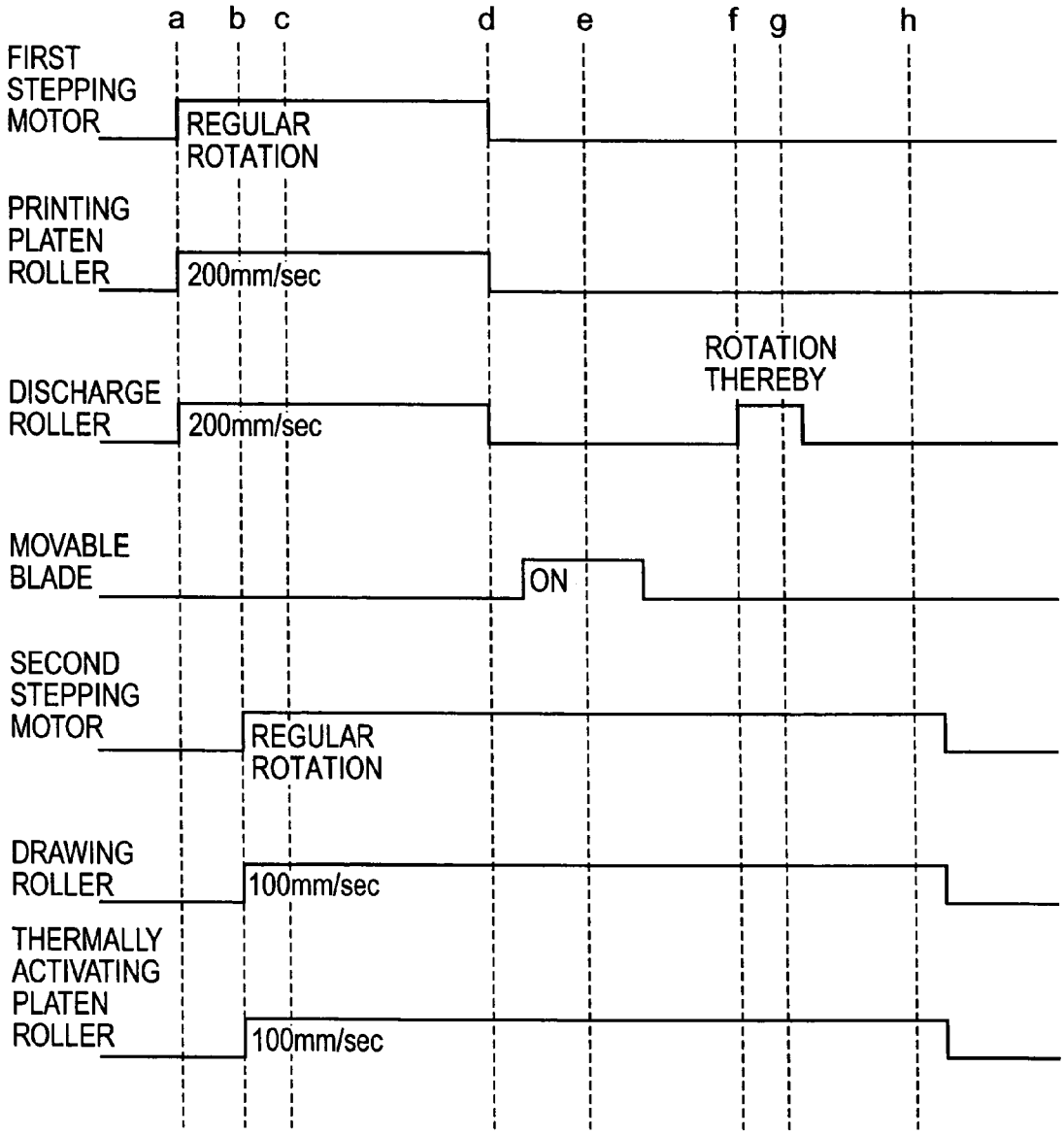
FIG. 12 is a timing chart showing states of driving the respective driving means and the respective transporting means of the thermal printer P1.
Figure 13A:
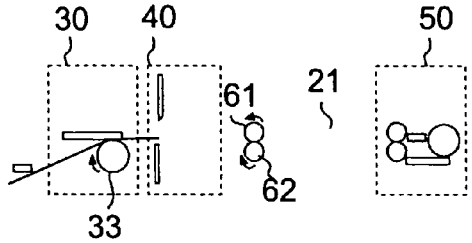
FIG. 13A–13H are an explanatory view showing states of transporting the thermally sensitive adhering label 21.
Figure 13B:
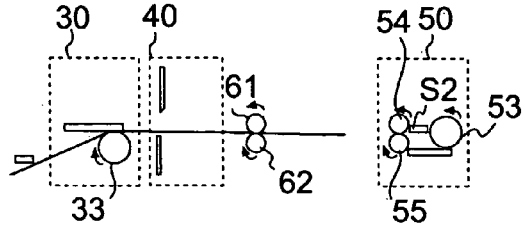
Figure 13C:
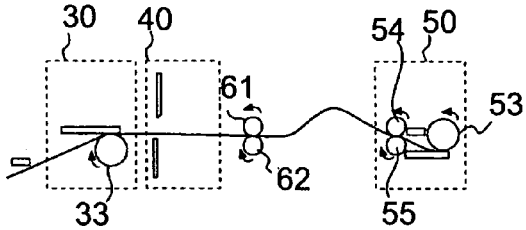
Figure 13D:
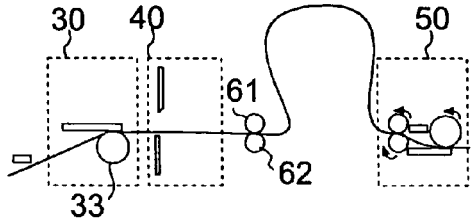
Figure 13E:
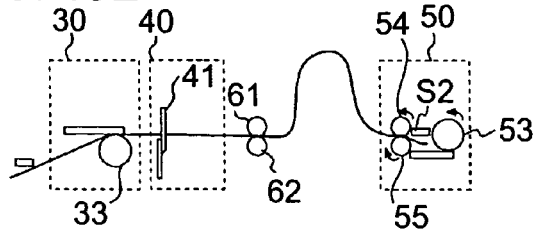
Figure 13F:
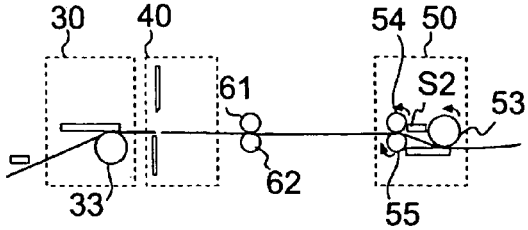
Figure 13G:
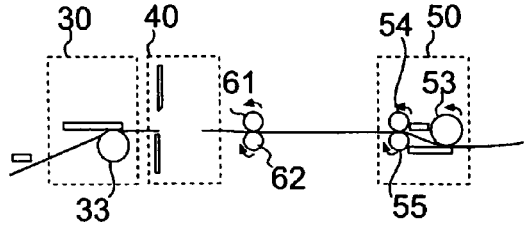
Figure 13H:
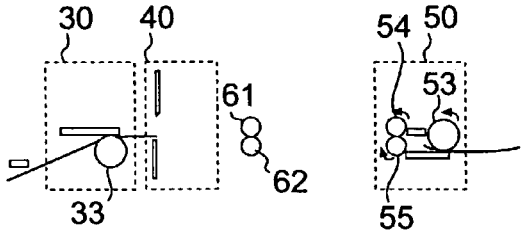
Figure 14:
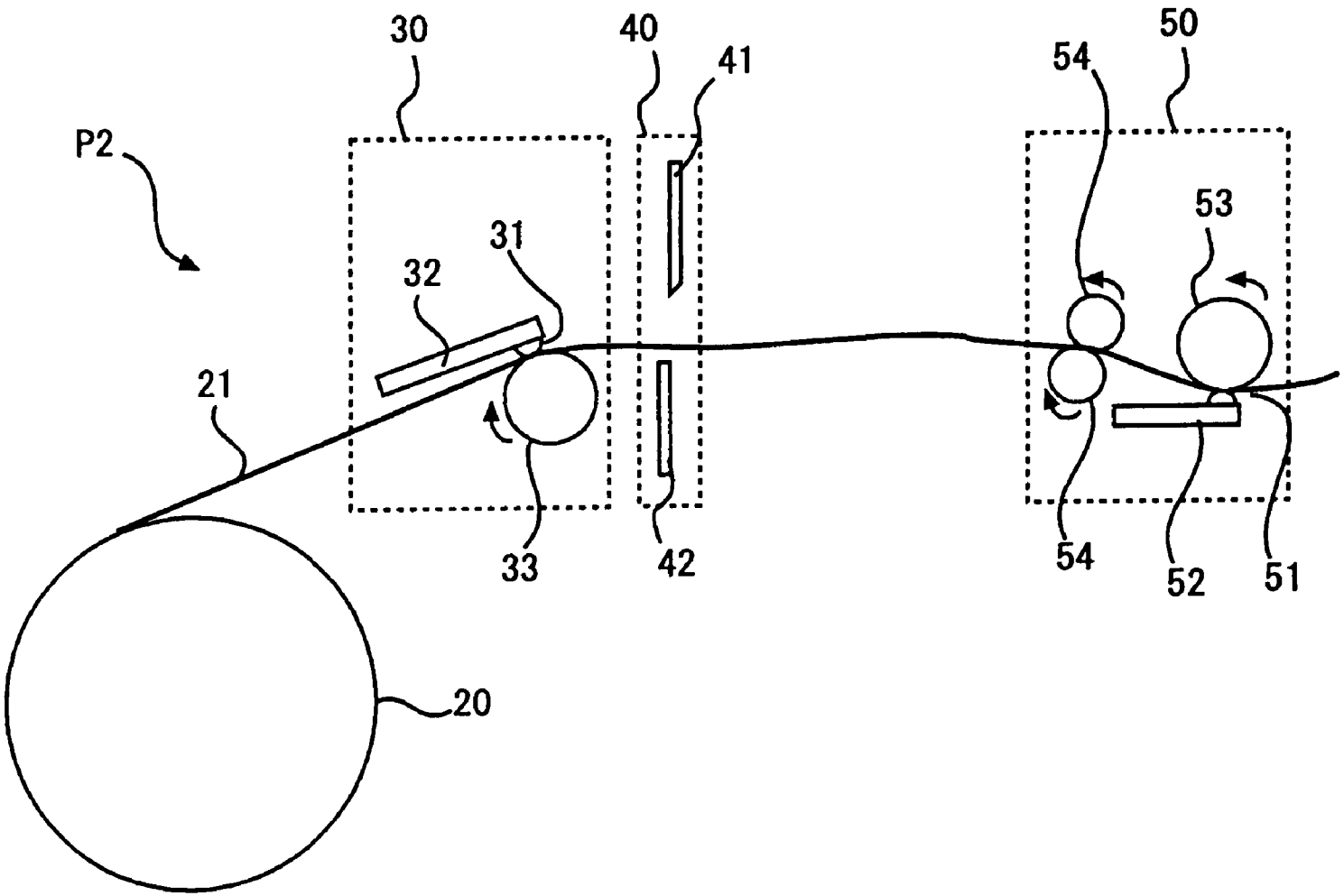
FIG. 14 is an outline view showing a constitution example of a thermal printer P2 of a prior art.

Next, an explanation will be given of a printing processing and a thermally activating processing of procedure C of FIG. 4 with regard to the case of the label length of 200 mm in reference to FIGS. 11 through 13. FIG. 11 is a flowchart of procedure C and FIG. 12 is a timing chart showing states of driving the motors, the rollers and the like. Further, FIG. 13 is an explanatory view showing states of transporting the thermally sensitive adhering label 21 and respective states (a) through (h) correspond to notations a through h attached to an upper portion of the timing chart of FIG. 12.

Further, the processing of procedure C is substantially similar to the processing of procedure B and differs therefrom in that whereas in procedure B, the second stepping motor 111 is temporarily stopped at step S205 and restarted at step S209, in procedure C, the processing of stopping and restarting the stepping motor 111 in this way is not carried out.

First, at step S301, the first stepping motor 110 is rotated regularly, the printing platen roller 33 and the discharge roller 61 are started to drive to rotate, the thermally sensitive adhering label 21 is drawn at transporting speed of 200 mm/sec and the printable layer (thermally sensitive coloring layer) is printed by the printing thermal head 52 (notation a of FIGS. 12, 13)

Next, when it is determined that a predetermined length (40 mm) of the label has been transported at step S302, at step S303, the second stepping motor 111 is rotated regularly to start to drive to rotate the drawing roller 54 and the thermally activating platen roller 33 to be prepared for delivery of the label (notation b of FIGS. 12, 13).

Next, when the label 21 is detected based on the detection signal from the paper sensor S2 at step S304, electricity conduction to the thermally activating thermal head is started at step S305 (notation c of FIGS. 12, 13). Thereafter, the label 21 is transported at 200 mm/sec by the printing platen roller 33 and the discharge roller 61 and transported at 100 mm/sec by the drawing roller 54 and the thermally activating platen roller 53 and therefore, the label 21 is slacked between the discharge roller 61 and the drawing roller 54.

Next, when it is determined that the label of a predetermined length (200 mm) has been transported at step S306, the first stepping motor 110 is stopped to drive at step S307 (notation d of FIGS. 12, 13). Thereafter, the label 21 is started to be cut by the movable blade 41 at step S308 (notation e of FIGS. 12, 13). At this occasion, during a time period of cutting the label 21 by the movable blade 41, a slacked amount of the label 21 is transported and therefore, the label 21 can be cut while being transported.

Next, when the slack of the label 21 is removed, the discharge roller 61 is rotated thereby in accordance with transportation of the label 21 (notations f, g of FIGS. 12, 13). Further, the thermally activating processing is carried out until it is determined that the final end of the label 21 has passed based on the detection signal from the paper sensor S2 at step S309. Further, after a predetermined time period after the final end of the label has passed the paper sensor S2, at step S310, electricity conduction to the thermally activating thermal head 52 and driving of the second stepping motor 111 are stopped (notation h of FIGS. 12, 13).

In this way, according to the embodiment, the case of the label length equal to or larger than 120 mm, is dealt with by the above-described processing in accordance with procedure C. That is, in procedure C, cutting of the thermally sensitive adhering label 21 can be carried out by the cutter unit 40 without stopping to transport the thermally sensitive adhering label at the thermally activating unit 50 and therefore, it can be avoided to bring about a failure in transportation by bringing about paper jam by pasting the thermally sensitive adhering agent layer of the thermally sensitive adhering label 21 on the thermally activating thermal head 52 (heat generating element 51).

According to the embodiment, the optimum printing processing and the optimum thermally activating processing can be carried out in accordance with the label length by carrying out the printing processing and the thermally activating processing by any of procedures A, B and C based on the length of the label to be printed as described above. Further, the embodiment can easily deal with a comparatively short label length of 40 mm through 60 mm as explained in procedure A.

Further, the distances among the respective transporting means are shortened by providing the discharge roller 61 and therefore, reliability of delivery of the thermally sensitive adhering label 21 from the printing unit 30 to the thermally activating unit 50 can be promoted.

Although a specific explanation has been given of the invention carried out by the inventors based on the embodiment as described above, the invention is not limited to the above-described embodiment and can variously be modified within the range not deviated from gist thereof.

Although according to the above-described embodiment, the discharge roller 61 is connected to the first stepping motor 110 via the one-way clutch 63 an transmission of power between the first stepping motor 110 and the discharge roller is limited to one direction to thereby deal with the drawback when the discharge roller 61 is rotated thereby in accordance with transportation of the label by the drawing roller 53 (drawing of extra label, load for motor or the like), other method of dealing therewith is conceivable.

For example, when several pieces of O-rings are arranged on a peripheral face of the discharge roller 61, the O-rings and the discharge roller 62 are brought into point contact with each other, friction force therebetween is reduced as less as possible and therefore, it can be avoided to rotate the discharge roller 61 per se in accordance with transportation of the label by the drawing roller 54 and the thermally activating platen roller 53.

Further, for example, when the discharge rollers 61 and 62 are constructed so as to be able to be brought proximate to each other and remote from each other and when the drive mechanism connected with the first and the third transporting means is stopped, the discharge rollers 61 and 62 may be separated from each other.

By this construction, even when the discharge roller is rotated after stopping the drive mechanism, the rotation is not transmitted to the drive mechanism or the first transporting means and therefore, extra sheet can be prevented from being transported by rotating the first transporting means and extra load can be prevented from being applied on the drive mechanism.

Further, although an explanation has been given of the above-described embodiment applied to a printing apparatus of a thermally transcribing type such as a thermal printer, the invention is applicable also to a printing apparatus of an ink jet type, a laser print type or the like. In that case, there is used a label in which a printable layer of the label is subjected to working suitable for the respective printing types in place of the thermally sensitive printing layer.

According to the invention, in a printer for a thermally sensitive adhering sheet including at least a printing apparatus, a cutter apparatus provided at a poststage of the printing apparatus and a thermally activating apparatus arranged at a predetermined interval from a poststage of the cutter apparatus, third transporting means for transporting the thermally sensitive adhering sheet in a predetermined direction is provided between the cutter apparatus and the thermally activating apparatus and therefore, there is achieved an effect of capable of dealing with a case of a short sheet length and capable of promoting reliability of delivery of sheet from the printing apparatus to the thermally activating apparatus.

What is claimed is:

1. A printer for a thermally sensitive adhesive sheet, the printer comprising:

a printing apparatus comprising printing means for printing during a printing operation on a printable surface of a thermally sensitive adhesive sheet having a thermally sensitive adhesive layer formed on a surface opposite to the printable surface, and first transporting means for transporting the thermally sensitive adhesive sheet in a first predetermined direction and in a second predetermined direction opposite to the first predetermined direction;

a cutter apparatus for cutting the thermally sensitive adhesive sheet by a predetermined length after a printing operation by the printing means;

a thermally activating apparatus comprising heating means disposed at a preselected distance from the cutter apparatus for heating the thermally sensitive adhesive layer of the thermally sensitive adhesive sheet, and second transporting means for transporting the thermally sensitive adhesive sheet in the first predetermined direction;

third transporting means for transporting the thermally sensitive adhesive sheet in the first predetermined direction between the cutter apparatus and the thermally activating apparatus, the third transporting means comprising at least one discharge roller, a pressing member for pressing the thermally sensitive adhesive sheet against the discharge roller when the thermally sensitive adhesive sheet is transported between the pressing member and the discharge roller, and a drive mechanism for rotationally driving the discharge roller in a first direction of rotation while the pressing member presses the thermally sensitive adhesive sheet to transport the thermally sensitive adhesive sheet in the first predetermined direction, the discharge roller being connected to the drive mechanism via a one-way clutch so that when the first transporting means transports the thermally sensitive adhesive sheet in the second predetermined direction, the drive mechanism does not rotate the discharge roller in a second direction of rotation opposite to the first direction of rotation; and control means for independently controlling the first and second transporting means to thereby independently control a transporting speed of the thermally sensitive adhesive sheet during transportation thereof by the first and second transporting means.

2. A printer for a thermally sensitive adhesive sheet according to claim 1; wherein the first transporting means comprises the drive mechanism of the third transporting means for transporting the thermally sensitive adhesive sheet in the predetermined direction.

3. A printer for a thermally sensitive adhesive sheet according to claim 1; wherein the discharge roller is configured to be partially brought into contact with the pressing member in a state in which the thermally sensitive adhesive sheet is not transported between the pressing member and the discharge roller.

4. A printer for a thermally sensitive adhesive sheet according to claim 1; further comprising moving means for moving the discharge roller and the pressing member toward each other to press the thermally sensitive adhesive sheet against the discharge roller and away from each other to release the thermally sensitive adhesive sheet from the discharge roller.

5. A printer for a thermally sensitive adhesive sheet according to claim 1; wherein the pressing member comprises an auxiliary roller having outer peripheral portions for contacting outer peripheral portions of the discharge roller when the thermally sensitive adhesive sheet is transported between the auxiliary roller and the discharge roller.

6. A printer for a thermally sensitive adhesive sheet, the printer comprising:

a printing apparatus comprising printing means for printing during a printing operation on a printable surface of a thermally sensitive adhesive sheet having a thermally sensitive adhesive layer formed on a surface opposite to the printable surface, and first transporting means comprising a platen roller for transporting the thermally sensitive adhesive sheet in a first predetermined direction and in a second predetermined direction opposite to the first predetermined direction;

a cutter apparatus for cutting the thermally sensitive adhesive sheet by a predetermined length after a printing operation by the printing means;

a thermally activating apparatus comprising heating means disposed at a preselected distance from the cutter apparatus for heating the thermally sensitive adhesive layer of the thermally sensitive adhesive sheet, and second transporting means for transporting the thermally sensitive adhesive sheet in the first predetermined direction;

third transporting means comprising a discharge roller for transporting the thermally sensitive adhesive sheet in the first predetermined direction between the cutter apparatus and the thermally activating apparatus; and control means for independently controlling the first and second transporting means to thereby independently control a transporting speed of the thermally sensitive adhesive sheet during transportation thereof by the first and second transporting means;

wherein the first transporting means and the third transporting means comprise a drive mechanism for transporting the thermally sensitive adhesive sheet in the first predetermined direction, the drive mechanism having a stepping motor for rotationally driving the platen roller and the discharge roller in a first direction to transport the thermally sensitive adhesive sheet in the first predetermined direction, the discharge roller being connected to the drive mechanism via a one-way clutch so that when the first transporting means transports the adhesive sheet in the second predetermined direction, the drive mechanism does not rotate the discharge roller in a second direction of rotation opposite to the first direction of rotation.

7. A printer for a thermally sensitive adhesive sheet according to claim 6; wherein the second transporting means comprises a platen roller and a drive mechanism having a stepping motor for rotationally driving the platen roller of the second transporting means.

8. A printer for a thermally sensitive adhesive sheet according to claim 7; wherein the control means includes means for independently controlling a rotational speed of each of the first and second stepping motors.

9. A printer comprising:

a printing unit for printing during a printing operation on a printable surface of a thermally sensitive adhesive sheet having a thermally sensitive adhesive layer formed on a surface opposite to the printable surface;

a first transporting mechanism for transporting the thermally sensitive adhesive sheet through the printing unit;

a thermally activating unit for heating the thermally sensitive adhesive layer of the thermally sensitive adhesive sheet;

a second transporting mechanism for transporting the thermally sensitive adhesive sheet through the thermally activating unit;

a third transporting mechanism for transporting the thermally sensitive adhesive sheet from the printing unit to the thermally activating unit; and control means for controlling the first and third transporting mechanisms as a transporting unit to transport the thermally sensitive adhesive sheet at a preselected speed, and for independently controlling the transporting unit and the second transporting mechanism to thereby independently control the preselected speed and a transporting speed of the thermally sensitive adhesive sheet during transportation thereof by the transporting unit and the second transporting mechanism.

10. A printer according to claim 9; wherein each of the first, second and third transporting mechanisms comprises at least one roller mounted for undergoing rotation to transport the thermally sensitive adhesive sheet.

11. A printer according to claim 10; wherein the first and third transporting mechanisms further comprise a first drive mechanism for rotationally driving the roller of each of the first and third transporting mechanisms; and wherein the second transporting mechanism further comprises a second drive mechanism for driving the roller of the second transporting mechanism.

12. A printer according to claim 11; wherein the first and second drive mechanisms comprise first and second stepping motors, respectively; and wherein the control means includes means for independently controlling a rotational speed of each of the first and second stepping motors.

13. A printer according to claim 11; wherein the roller of the third transporting mechanism is connected to the first drive mechanism via a one-way clutch.

14. A printer according to claim 11; wherein the second transporting mechanism further comprises a pair of drawing rollers driven by the second drive mechanism for drawing the thermally sensitive adhesive sheet toward the roller of the second transporting mechanism.

15. A printer according to claim 10; wherein the third transporting mechanism further comprises an auxiliary roller mounted for undergoing rotation and for contacting the roller of the third transporting mechanism to transport the thermally sensitive adhesive sheet during rotation of the roller and auxiliary roller of the third transporting mechanism.

16. A printer according to claim 9; further comprising a cutter apparatus for cutting the thermally sensitive adhesive sheet after a printing operation by the printing unit.

* * * * *